US006715382B1

(12) United States Patent
Hsien

(10) Patent No.: US 6,715,382 B1
(45) Date of Patent: Apr. 6, 2004

(54) CONTROL ASSEMBLY FOR A RATCHET TOOL

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/289,278

(22) Filed: Nov. 7, 2002

(51) Int. Cl.[7] ..... B25B 13/26

(52) U.S. Cl. ..... 81/63.2; 81/60; 81/61; 81/62; 81/63; 81/63.1

(58) Field of Search ..... 81/60–63.2

(56) References Cited

U.S. PATENT DOCUMENTS 5,887,493 A * 3/1999 Main ..... 81/57.29

6,568,299 B2 * 5/2003 Hu ..... 81/63.2

* cited by examiner

*Primary Examiner*—Joseph J. Hail, III
*Assistant Examiner*—Alvin J Grant
(74) *Attorney, Agent, or Firm*—Rosenberg, Klein & Lee

(57) ABSTRACT

A ratchet tool includes a head having a hole for receiving an engaging member therein and a recess is defined in an inner periphery of the hole so as to receive a pawl which is engaged with the engaging member. A passage is defined through the head and communicates with the recess. Two notches are defined in an inner periphery of the passage. A shifter member is rotatably received in the passage and has a lever is located on an outside of the head. A bead and a spring are received in a hole of the shifter member and the bead is engaged with one of the two notches. The spring is engaged with a second side of the pawl.

2 Claims, 5 Drawing Sheets

CONTROL ASSEMBLY FOR A RATCHET TOOL

FIELD OF THE INVENTION

The present invention relates to a control assembly for a ratchet tool and includes a shifter with a bead and spring engaged with a passage in the shifter and the bead is engaged with one of two notches in the head and the spring is engaged with the pawl.

BACKGROUND OF THE INVENTION

A conventional ratchet tool generally includes a head with a hole defined therethrough and a toothed engaging member is rotatably received in the hole of the head. The head further has a recess defined in an inner periphery of the hole and a ratchet mechanism is received in the recess wherein a pawl is engaged with the toothed engaging member and controlled by a shifter. The pawl is shifted by the shifter which is operated by the user and the pawl is shifted to either end of the recess so that the engaging member is rotated with the tool to put a torque in one direction and is rotated independently from the tool in the other direction. The positioning of the pawl is important to the ratchet mechanism and the function of the ratchet tool. Most of the conventional ratchet mechanism employs a bead to push the pawl and this is not able to securely position the pawl at the desired position.

The present invention intends to provide a ratchet mechanism that provides a firm positioning force to the pawl which is then engaged with the toothed engaging member firmly.

SUMMARY OF THE INVENTION

In accordance with one aspect of the present invention, there is provided a ratchet tool which comprises a head having an engaging member rotatably received in a hole in the head and a recess is defined in an inner periphery of the hole so as to receive a pawl therein which is engaged with the engaging member. A passage is defined through the head and communicates with the recess. Two notches are defined in an inner periphery of the passage. A shifter member is rotatably received in the passage and has a lever outside of the head. A through hole is defined through the shifter member and a bead and a spring are received in the through hole. The bead is engaged with one of the two notches and the spring is engaged with a second side of the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
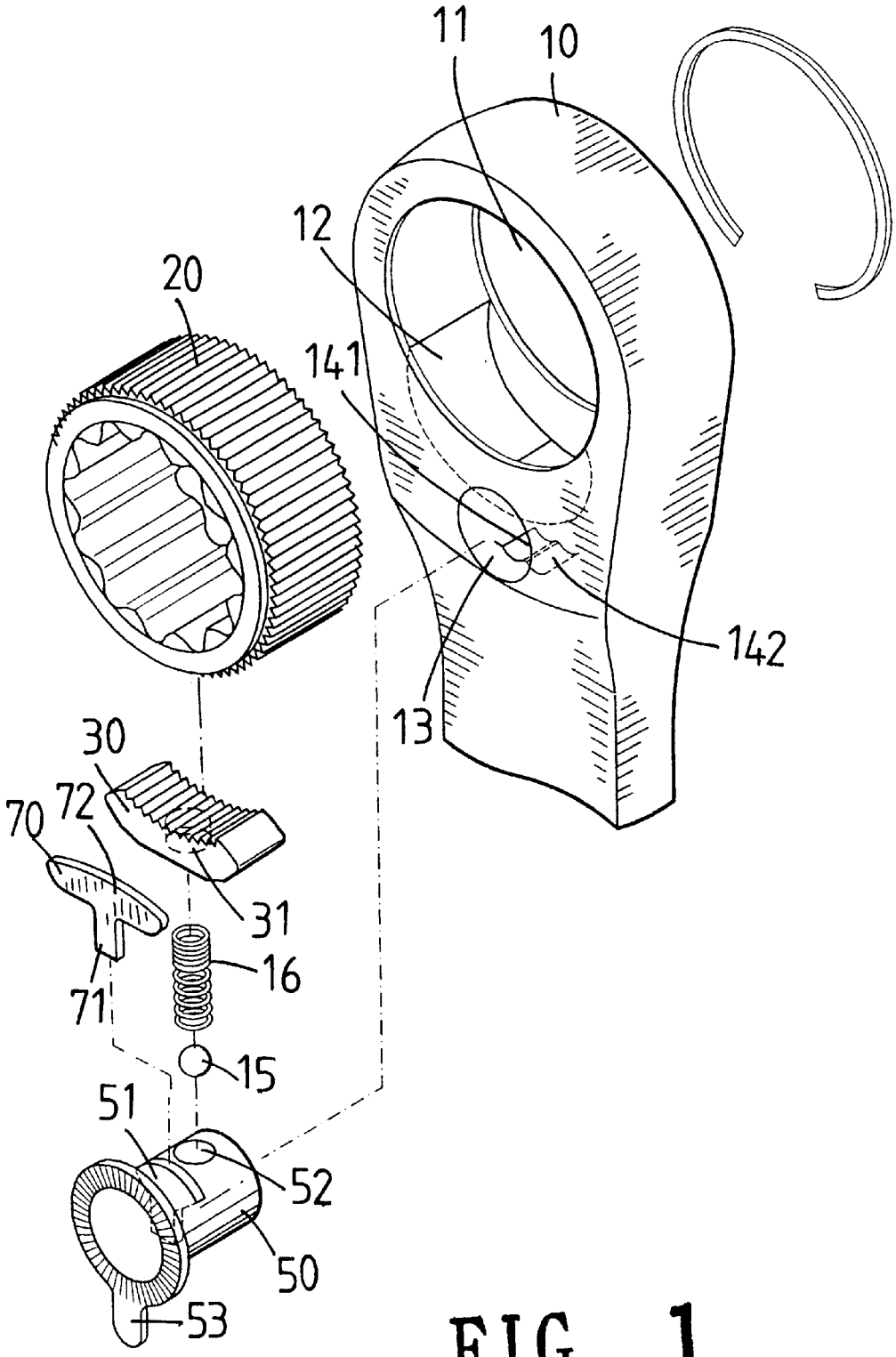
FIG. 1 is an exploded view to show the ratchet tool of the present invention.

Referring to FIGS. 1, 2, 4 and 5, the ratchet tool of the present invention coprises a head 10 having a hole 11 defined therethrough and a recess 12 is defined in an inner periphery of the hole 11. A passage 13 is defined through the head 10 and communicates with the recess 12. Two notches 141, 142 are defined in an inner periphery of the passage 13.

An engaging member 20 has a toothed periphery and is rotatably engaged with the hole 11. A pawl 30 is movably received in the recess 12 and a toothed surface is defined in a first side thereof. The toothed surface is engaged with the toothed outer periphery of the engaging member 20. A shifter member 50 is rotatably received in the passage 13 and has a lever 53 on an outside of the head 10. A through hole 52 is defined through the shifter member 50 and a bead 15 and a spring 16 are received in the through hole. The bead 15 is biased by the spring 16 and engaged with one of the two notches 141, 142. The spring 16 is engaged with a concavity 31 defined in the second side of the pawl 30.

The shifter member 50 has an insertion hole 51 and a T-shaped retaining plate 70 is inserted therein. The retaining plate 70 includes an insertion portion 71 to be inserted in the insertion hole 51 and a transverse bar 72 which limits the spring 16 in the through hole 52.

Figure 2:
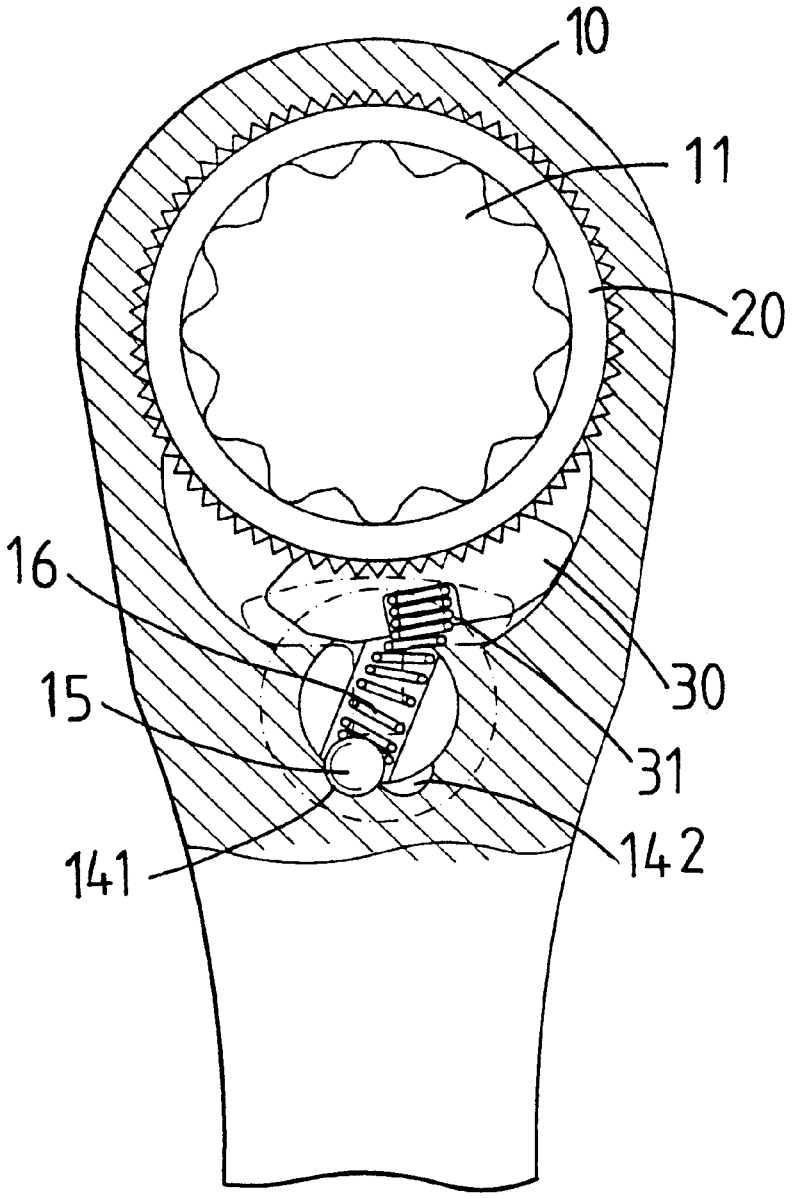
FIG. 2 is a cross sectional view to show the ratchet mechanism of the ratchet tool of the present invention, the pawl is shifted to right.

When the shifter member 50 is shifted to left as shown in FIG. 2, the bead 15 is engaged with the notch 141 and the spring 16 pushes the pawl 30 to right so that the ratchet tool can output a torque when turning counter clockwise.

Figure 3:
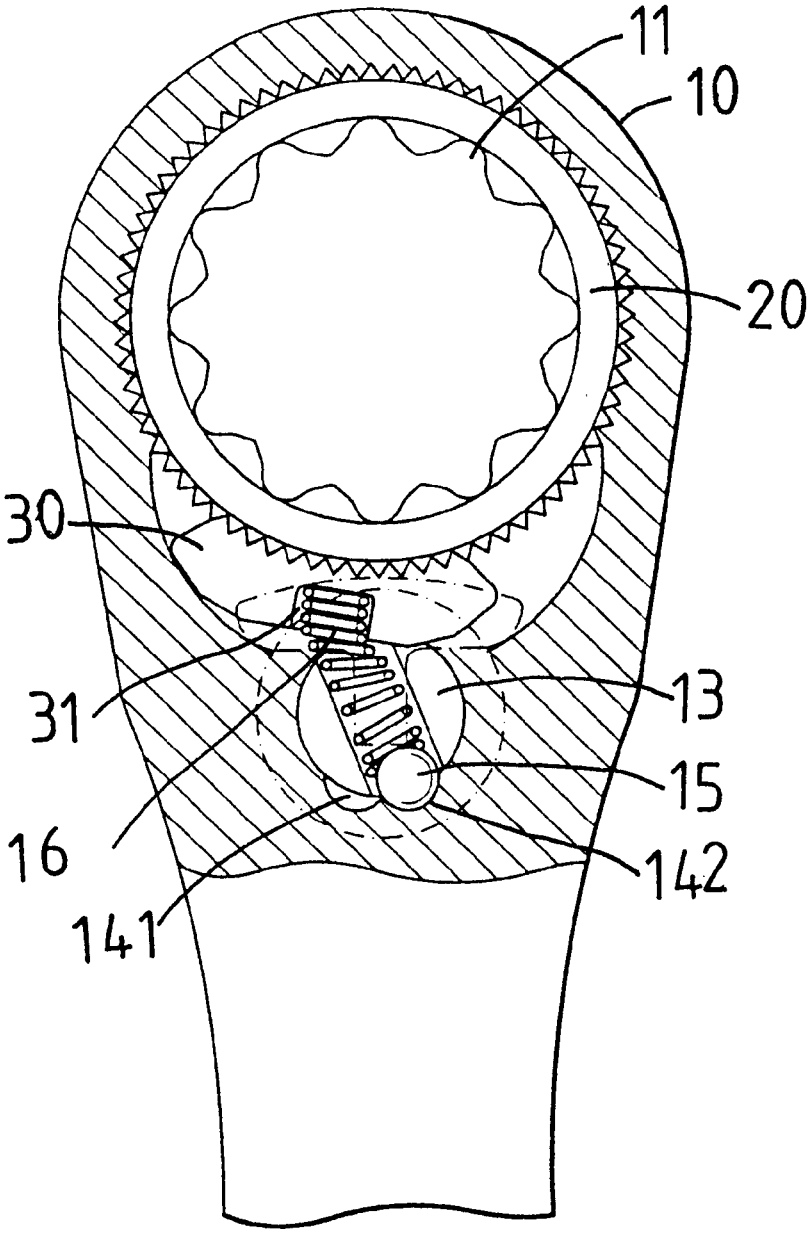
FIG. 3 shows the pawl is shifted to left.
Figure 4:
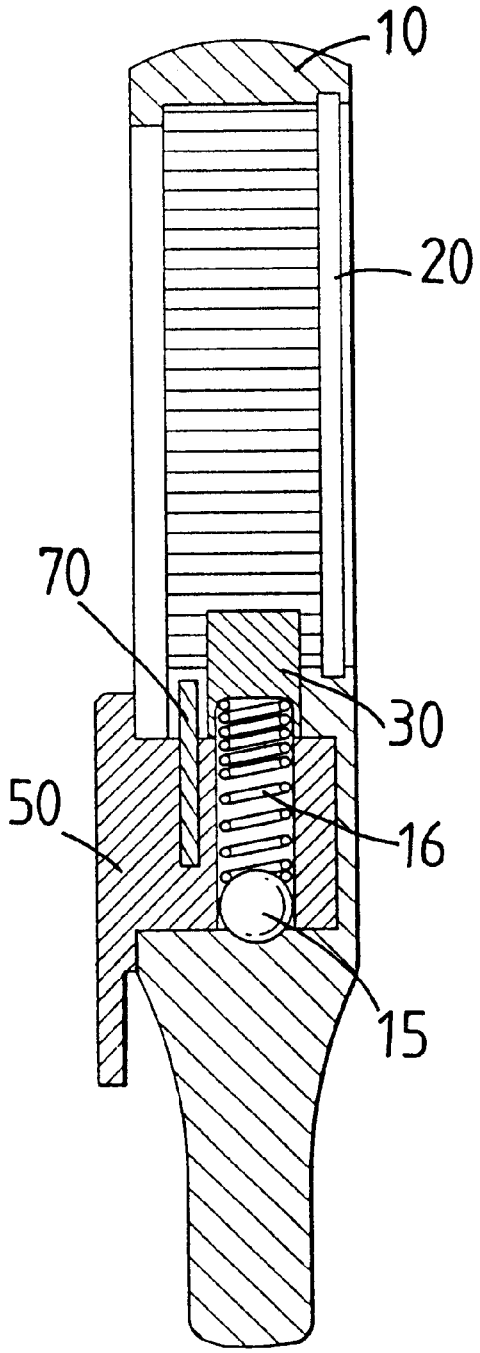
FIG. 4 is a side cross sectional view of the ratchet tool of the present invention.
Figure 5:
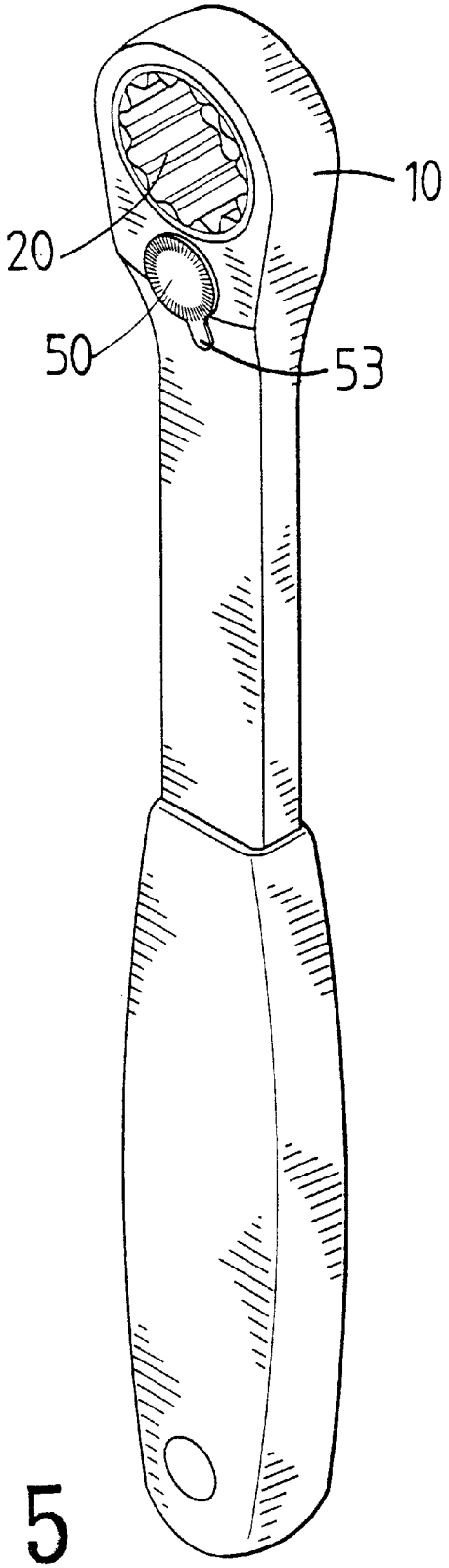
FIG. 5 is a perspective view to show the ratchet tool of the present invention.

As shown in FIG. 3, when the shifter member 50 is shifted to right, the bead 15 is engaged with the notch 142 and the spring 16 pushes the pawl 30 to left so that the ratchet tool can output a torque when turning clockwise.

The engagement of the bead 15 in the notch 141/142 makes the spring 16 be oriented at desired direction so as to firmly urge the pawl 30.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a recess defined in an inner periphery of the hole, a passage defined through the head and communicating with the recess, two notches defined in an inner periphery of the passage;

an engaging member rotatably engaged with the hole;

a pawl movably received in the recess and a toothed surface defined in a first side thereof, the toothed surface engaged with the engaging member, and a shifter member rotatably received in the passage and having a lever on an outside of the head, a through hole defined through the shifter member and a bead and a spring received in the through hole, the bead engaged with one of the two notches, the spring engaged with a second side of the pawl, the shifter member having an insertion hole and a retaining plate is inserted therein, the retaining plate including a transverse bar which is located in parallel with an end of the pawl and limits the spring in the through hole.

2. The ratchet tool as claimed in claim 1, wherein a concavity is defined in the second side of the pawl and the spring is engaged with the concavity.

* * * * *